US012593904B1

(12) United States Patent
Maydew

(10) Patent No.: US 12,593,904 B1
(45) Date of Patent: Apr. 7, 2026

(54) HAIR DRYING AND DAMAGE REDUCTION SYSTEM AND METHOD

(71) Applicant: Alexis Maydew, Encino, CA (US)

(72) Inventor: Alexis Maydew, Encino, CA (US)

( * ) Notice: Subject to any disclaimer, the term of this patent is extended or adjusted under 35 U.S.C. 154(b) by 0 days.

(21) Appl. No.: 19/266,972

(22) Filed: Jul. 11, 2025

Related U.S. Application Data

(63) Continuation of application No. 19/239,699, filed on Jun. 16, 2025.

(51) Int. Cl.
*A45D 20/12* (2006.01)

(52) U.S. Cl.
CPC ..... *A45D 20/122* (2013.01)

(58) Field of Classification Search
CPC ..... A45D 20/12
USPC ..... 34/98, 96, 89, 283
See application file for complete search history.

(56) References Cited

U.S. PATENT DOCUMENTS 931,881 A * 8/1909 Marr ..... A45D 20/18 34/97
4,692,594 A * 9/1987 Martin ..... A45D 20/52 392/385
4,736,528 A * 4/1988 Sahm ..... A45D 4/10 34/101
4,809,444 A * 3/1989 Henderson ..... A45D 4/10 34/98
2010/0212179 A1* 8/2010 Schmid ..... A45D 7/02 392/386
2012/0291301 A1* 11/2012 Silva ..... A45D 20/24 34/98
2017/0245614 A1* 8/2017 Porter ..... A45D 20/122
2023/0301414 A1* 9/2023 Park ..... B05B 1/02

FOREIGN PATENT DOCUMENTS

CN 210329721 U * 4/2020
KR 1020240082082 * 6/2024

* cited by examiner

*Primary Examiner* — John P McCormack
(74) *Attorney, Agent, or Firm* — Seed Intellectual Property Law Group LLP

(57) ABSTRACT

A hair drying and damage reduction system is disclosed. The system includes a base, a hose, and a plurality of perforated hollow tentacles. The base has a gripper opening side and a tentacle-mounting side. The gripper opening side includes a single central opening and the tentacle-mounting side includes a plurality of apertures through which heated air passes to the plurality of perforated hollow tentacles. The hose attaches to the gripper opening side of the base at a first end and attaches to a hair dryer at a second end. The plurality of perforated hollow tentacles each has a hollow tube root and a closed tip. The hollow tube root of each tentacle is configured to mount in one of the plurality of apertures in the tentacle-mounting side of the base.

20 Claims, 6 Drawing Sheets

HAIR DRYING AND DAMAGE REDUCTION SYSTEM AND METHOD

TECHNICAL FIELD

The present disclosure generally relates to a hair drying and damage reduction system and method. More particularly, the present disclosure relates to a hair drying and damage reduction system and method that protects hair from damage during a hair drying process.

DESCRIPTION OF THE RELATED ART

For an extended period of time, people have endeavored to dry and style their hair in a wide variety of different ways. Accordingly, while numerous ways exist to achieve various hair styles, many of these techniques have significant drawbacks and disadvantages. Such drawbacks and disadvantages of these legacy techniques include significant cost requirements, significant time requirements, damage to the hair, and less than satisfactory results For example, hair drying, can often result in damage to the hair, as well as clumps, knots, and tangles in the hair. Additionally, removing these clumps, knots, and tangles from the hair can cause pain to the subject of the procedure, as well as pulling out hair and further damaging the hair in other aspects. It would be desirable to find another way to dry hair without all of these significant drawbacks and disadvantages. There is a continuing need in the art for hair drying techniques that are faster, more efficient, easy to perform, and less damaging to the hair.

Notably, not all of the subject matter discussed in this section is necessarily prior art and should not be assumed to be prior art merely as a result of its discussion in this section. Accordingly, any recognition of problems in the prior art discussed in this section or associated with such subject matter should not be treated as prior art unless expressly stated to be prior art. Instead, the discussion of any subject matter in this section should be treated as part of the identification of the technological problem to be overcome, which in and of itself may also be inventive.

BRIEF SUMMARY

A hair drying and damage reduction system may be summarized as including a base, a hose, and a plurality of perforated hollow tentacles that extend from the base. The base of the hair drying and damage reduction system has a gripper opening side and a tentacle-mounting side. The gripper opening side includes a single central opening. The tentacle-mounting side includes a plurality of apertures through which heated air passes to the plurality of perforated hollow tentacles. The hose is operatively associated with the gripper opening side of the base at a first end and attaches to a hair dryer at a second end. The plurality of perforated hollow tentacles each include a hollow tube root and a closed tip. The hollow tube root of each tentacle is configured to mount in one of the plurality of apertures in the tentacle-mounting side of the base. When the hose of the base is connected to a hair dryer (or other hot air source), hot air passes through the hose and the base of the hair drying and damage reduction system, and continues through the plurality of apertures and out of the corresponding plurality of perforated hollow tentacles.

In some embodiments of the hair drying and damage reduction system, a first set of the plurality of perforated hollow tentacles are of a first length and a second set of the plurality of perforated hollow tentacles are of a second longer length. In another embodiment of the hair drying and damage reduction system, some of the plurality of apertures in the tentacle-mounting side of the base are mounted with stabilizing members that are shorter than the plurality of perforated hollow tentacles. In still another embodiment of the hair drying and damage reduction system, the tentacles have an exterior surface that is perforated over 360 degrees of the exterior surface for even hair drying. In yet another embodiment of the hair drying and damage reduction system, the tips of the plurality of perforated hollow tentacles are tapered or capped.

In one or more embodiments, the hair drying and damage reduction system further includes an octopus arm attachment that is securable to the gripper opening side of the base. In other embodiments, the hair drying and damage reduction system further includes a hand-free wedge for positioning the base and the plurality of perforated hollow tentacles. In some embodiments, the hand-free wedge is attachable to the base using a hook and latch (e.g., Velcro™) strap. In still other embodiments, the hair drying and damage reduction system further includes a hand-free neck loop.

In some embodiments, the hand-free neck loop includes a single loop that secures the base to a neck of a user. In still other embodiments, the hair drying and damage reduction system further includes a hand-free base positioning system that includes a non-slip stretch band that is connected to ear loops.

In some such embodiments, the non-slip stretch band secures to the base and ear loops secure the base to ears of a user.

Referring now to another embodiment, a hair drying and damage reduction method may be summarized as including: securing a plurality of perforated hollow tentacles to a plurality of apertures in a tentacle-mounting side of a base of the hair drying and damage reduction system, each tentacle having a hollow tube root and a closed tip, the hollow tube root of each tentacle being configured to mount in one of the plurality of apertures in the tentacle-mounting side of the base; securing a hose of the hair drying and damage reduction system to a gripper opening side of the base of the hair drying and damage reduction system at a first end of the hose; securing the hose of the hair drying and damage reduction system to a hair dryer at a second end of the hose; positioning the plurality of perforated hollow tentacles into hair on a scalp of a user to dry the hair of the user, wherein the plurality of perforated hollow tentacles are positioned to dry hair near the scalp prior to drying hair farther away from the scalp; and enabling activation of a hair dryer that directs air through the base and the plurality of perforated hollow tentacles of the hair drying and damage reduction system into the hair on the scalp of the user to evenly dry the hair of the user without damaging the hair.

In some embodiments of the hair drying and damage reduction method, a first set of the plurality of perforated hollow tentacles are of a first length and a second set of the plurality of perforated hollow tentacles are of a second longer length. In another embodiment of the hair drying and damage reduction method, some of the plurality of apertures in the tentacle-mounting side of the base are mounted with stabilizing members that are shorter than the plurality of perforated hollow tentacles. In still another embodiment of the hair drying and damage reduction method, the tentacles have an exterior surface that is perforated over 360 degrees of the exterior surface for even hair drying. In yet another embodiment of the hair drying and damage reduction method, the tips of the plurality of perforated hollow tentacles are tapered or capped.

In one or more embodiments, the hair drying and damage reduction method further includes an octopus arm attachment that is securable to the gripper opening side of the base. In other embodiments, the hair drying and damage reduction method further includes a hand-free wedge for positioning the base and the plurality of perforated hollow tentacles. In some embodiments, the hand-free wedge is attachable to the base using a hook and latch (e.g., Velcro™) strap. In still other embodiments, the hair drying and damage reduction system further includes a hand-free neck loop.

In some embodiments, the hand-free neck loop includes a single loop that secures the base to a neck of a user. In still other embodiments, the hair drying and damage reduction system further includes a hand-free base positioning system that includes a non-slip stretch band that is connected to ear loops. In some such embodiments, the non-slip stretch band secures to the base and ear loops secure the base to ears of a user.

A hair drying and damage reduction system may be summarized as including a base, a hair dryer, and a plurality of perforated hollow tentacles that extend from the base. The base having a gripper opening side and a tentacle-mounting side. The gripper opening side includes a single central opening. The tentacle-mounting side includes a plurality of apertures through which heated air passes. The hair dryer attaches to the gripper opening side of the base at a first end. The plurality of perforated hollow tentacles each have a hollow tube root and a closed tip. The hollow tube root of each tentacle is configured to mount in one of the plurality of apertures in the tentacle-mounting side of the base.

In some embodiments of the hair drying and damage reduction system, a first set of the plurality of perforated hollow tentacles are of a first length and a second set of the plurality of perforated hollow tentacles are of a second longer length. In another embodiment of the hair drying and damage reduction system, some of the plurality of apertures in the tentacle-mounting side of the base are mounted with stabilizing members that are shorter than the plurality of perforated hollow tentacles. In still another embodiment of the hair drying and damage reduction system, the tentacles have an exterior surface that is perforated over 360 degrees of the exterior surface for even hair drying. In yet another embodiment of the hair drying and damage reduction system, the tips of the plurality of perforated hollow tentacles are tapered or capped.

In one or more embodiments, the hair drying and damage reduction system further includes an octopus arm attachment that is securable to the gripper opening side of the base. In other embodiments, the hair drying and damage reduction system further includes a hand-free wedge for positioning the base and the plurality of perforated hollow tentacles. In some embodiments, the hand-free wedge is attachable to the base using a hook and latch (e.g., Velcro™) strap. In still other embodiments, the hair drying and damage reduction system further includes a hand-free neck loop. In some embodiments, the hand-free neck loop includes a single loop that secures the base to a neck of a user. In still other embodiments, the hair drying and damage reduction system further includes a hand-free base positioning system that includes a non-slip stretch band that is connected to ear loops. In some such embodiments, the non-slip stretch band secures to the base and ear loops secure the base to ears of a user.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed hair drying and damage reduction system and method readily suggest themselves to such skilled persons having the assistance of this disclosure.

Each of the features and teachings disclosed herein can be utilized separately or in conjunction with other features and teachings to provide a hair drying and damage reduction system and method. Representative examples utilizing many of these additional features and teachings, both separately and in combination, are described in further detail with reference to attached FIGS. 1-8. This detailed description is merely intended to teach a person of skill in the art further details for practicing aspects of the present teachings and is not intended to limit the scope of the claims. Therefore, combinations of features disclosed above in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present system and method. Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

Figure 1:
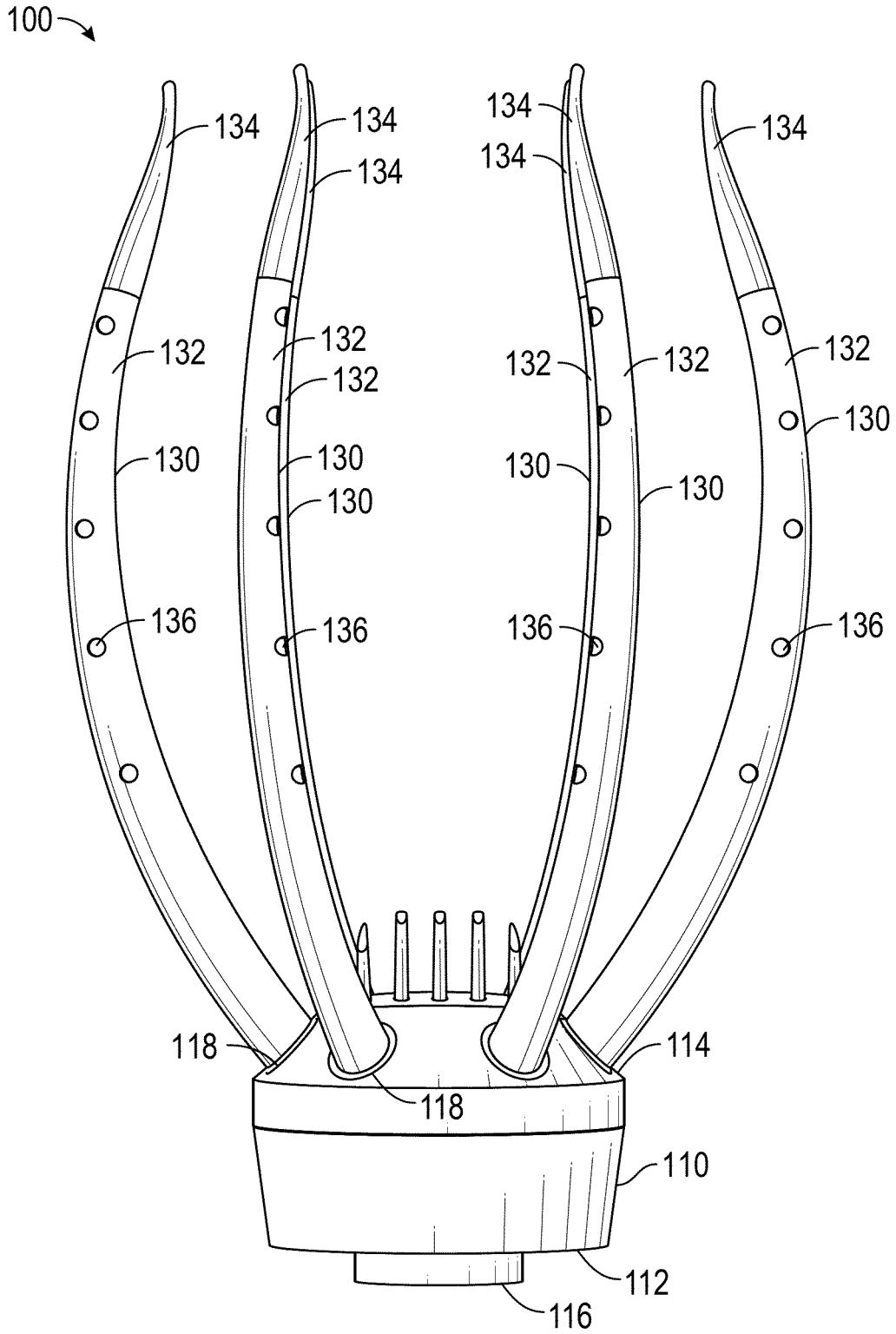
FIG. 1 is a side view of a hair drying and damage reduction system that includes a base having a gripper opening side and a tentacle-mounting side, the gripper opening side including a single central opening and the tentacle-mounting side including a plurality of apertures through which heated air passes into perforated hollow tentacles, according to one exemplary embodiment.

Referring now to FIG. 1, in one or more embodiments a hair drying and damage reduction system and method 100 is disclosed that is faster, more efficient, easy to perform, and less damaging to the hair than traditional hair drying techniques. Thus, not only is the hair drying and damage reduction system and method 100 dramatically faster than conventional hair drying techniques, it is also far less damaging to the hair. Traditionally, one of these benefits must be traded off to improve the other better (i.e., faster hair drying equates to greater potential hair damage, and slower hair drying equates to lower potential hair damage).

FIG. 1 shows a picture of a hair drying and damage reduction system 100 that includes a base 110, a hose 120 (shown in FIG. 5), and a plurality of perforated hollow tentacles 130. The base 110 has a gripper opening side 112 and a tentacle-mounting side 114. The gripper opening side 112 includes a single central opening 116 and the tentacle-mounting side 114 includes a plurality of apertures 118 through which heated air passes to the plurality of perforated hollow tentacles 130. The hose 120 attaches to the gripper opening side 112 of the base 110 at a first end and attaches to a hair dryer 150 (shown in FIG. 5) at a second end. The plurality of perforated hollow tentacles 130 each has a hollow tube body 132 and a closed tip 134. The hollow tube body 132 of each tentacle is configured to mount in one of the plurality of apertures 118 in the tentacle-mounting side 114 of the base 110. When the hose 120 and the base 110 of the hair drying and damage reduction system 100 are connected to a hair dryer 150 or other hot air source, hot air passes through the hose 120 and the base 110 of the hair drying and damage reduction system 100, and continues through the plurality of apertures 118 and out of perforations 136 in the corresponding plurality of perforated hollow tentacles 130.

Figure 2:
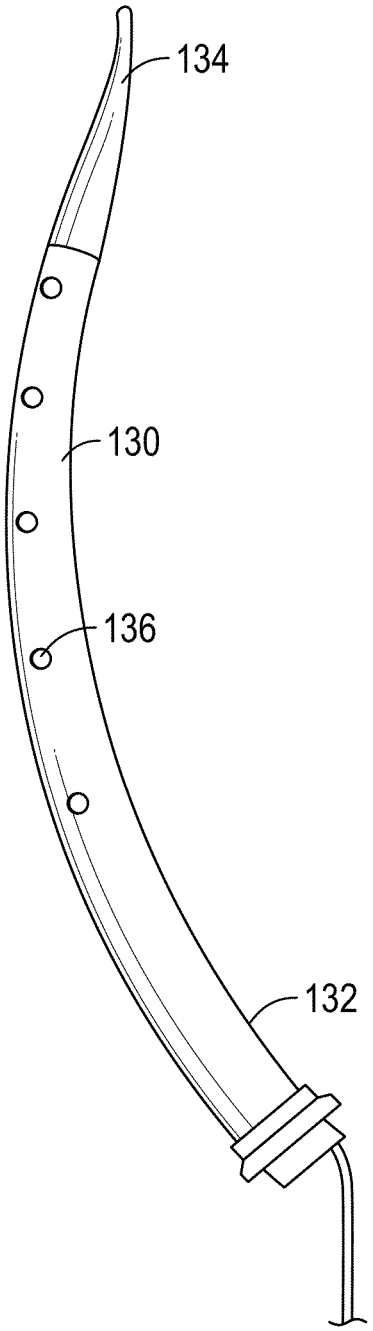
FIG. 2 is a close up perspective view of a single perforated hollow tentacle in detail, according to one exemplary embodiment.

Referring now to FIG. 2, a close up view of a single perforated hollow tentacle 130 is shown in detail. In this embodiments, single perforated hollow tentacle 130 has a hollow tube body 132 and a closed tip 134. The hollow tube body 132 of single perforated hollow tentacle 130 is configured to mount in one of the plurality of apertures 118 (shown in FIG. 1) in the tentacle-mounting side 114 of the base 110. As shown most clearly in FIG. 2, the perforations 136 in the single perforated hollow tentacle 130 enable air to flow out of the longitudinal sides of the tentacle 130 in order to air dry the user's hair.

Significantly, by enabling hot air to be dispensed all the way along the length of the perforated hollow tentacle 130, the hair drying and damage reduction system 100 is able to dry the hair evenly from the user's scalp to the tips of the user's hair, instead of drying the hair from the outside in (i.e., from the hair tip to the hair root), as is done with traditional hair dryers. When wet hair is dried from the outside in, as is done with traditional hair dryers, the outer hair (e.g., hair tips) are dried first, before the inner hair (e.g., hair roots) are dried. However, since the user typically wants all of their hair dried, they keep using the hair dryer until the inner hair is dried as well, which results in the over-drying and damaging of the outer hair. The hair drying and damage reduction system 100 prevents (or at least mitigates) this over-drying of the user's hair by drying the user's hair evenly from the inner hair near the user's scalp to the outer hair near the tips of the user's hair. Additionally, the interaction of the tips 134 of the tentacles 130 on the user's scalp during the hair drying process may also provide beneficial scalp stimulation.

As shown in FIGS. 1-3B, the tentacles 130 have an exterior surface that is perforated (with perforations 136) over the exterior surface of the hollow tube body 132 of the tentacles 130 for even hair drying. In another aspect of the hair drying and damage reduction system 100, the tips 134 of the plurality of perforated hollow tentacles 130 are tapered or capped so that no air can be dispensed out of the end of each perforated hollow tentacles 130. The closed tips 134 of the perforated hollow tentacles 130 force the hot air travelling through the hollow tentacles 130 to be diffused out of the perforations 136 along the length of the hollow tube body 132 of the tentacles 130.

Figure 3A:
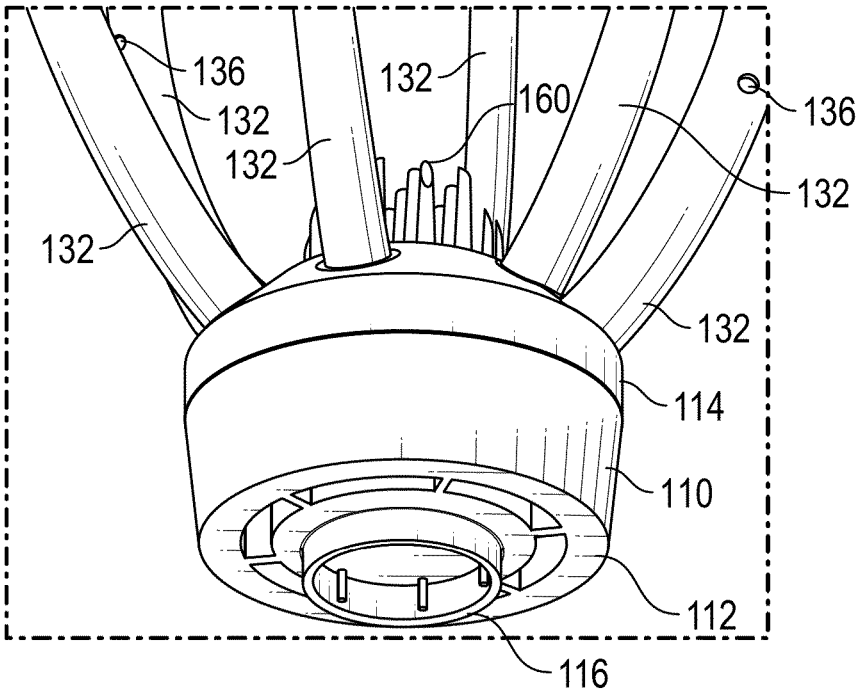
FIG. 3A is a close up perspective view of the base of the hair drying and damage reduction system with stabilizers on the base that are positioned among the perforated hollow tentacles, according to one exemplary embodiment.

Referring now to FIG. 3A, a close up perspective view of the base 110 of the hair drying and damage reduction system 100 is shown with stabilizers 160 on the tentacle-mounting side 114 of the base 110, which are positioned among the perforated hollow tentacles 130. As shown in FIGS. 1-4, in one or more embodiments there are six perforated hollow tentacles 130. In one or more embodiments of the hair drying and damage reduction system 100, some of the plurality of apertures 118 in the tentacle-mounting side 114 of the base 110 are mounted with stabilizing members 160 that are shorter than the plurality of perforated hollow tentacles 130. Additionally, as shown in FIG. 3A, the gripper opening side 112 includes a single central opening 116 to which a hair dryer or other hot air source may connect.

Figure 3B:
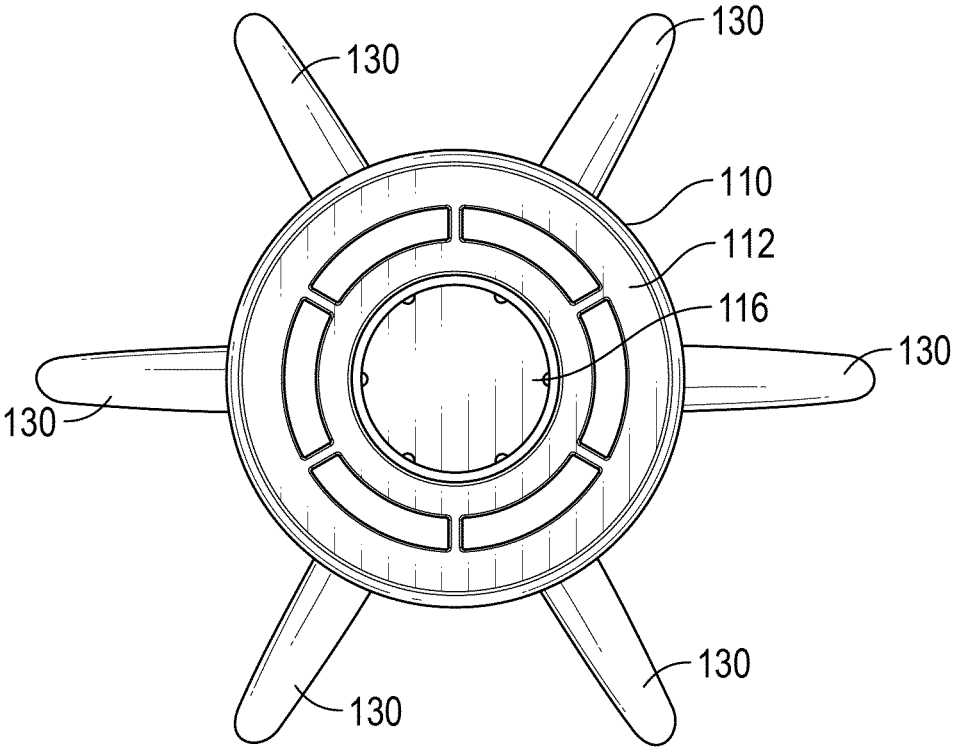
FIG. 3B is a bottom view of the base of the hair drying and damage reduction system that displays the gripper opening side, according to one exemplary embodiment.

Referring now to FIG. 3B, bottom view of the base 110 of the hair drying and damage reduction system that displays the gripper opening side 112 is shown. The single central opening 116 to which a hair dryer or other hot air source may connect to the gripper opening side 112 is also shown in detail. Additionally, the perforated hollow tentacles 130 from the tentacle-mounting side 114 of the base 110 may also seen protruding from the sides the base 110 of the hair drying and damage reduction system. In this embodiment, it may be clearly seen that there are six equally spaced perforated hollow tentacles 130 extending from the tentacle-mounting side 114 of the base 110. However, in other embodiments of the hair drying and damage reduction system, there may be either a larger number (e.g., 8, 9, 10, etc.) of perforated hollow tentacles 130 extending from the tentacle-mounting side 114 of the base 110 or a smaller number (e.g., 4, 5, etc.) of perforated hollow tentacles 130 extending from the tentacle-mounting side 114 of the base 110.

Figure 4:
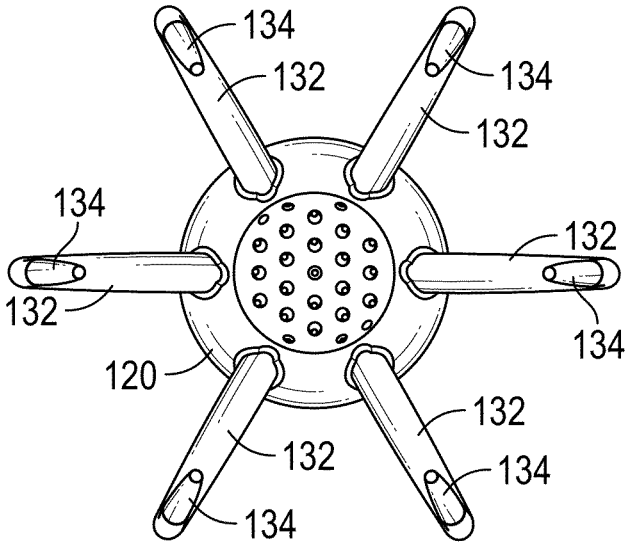
FIG. 4 is a top view of the base of the hair drying and damage reduction system that displays the stabilizers and the perforated hollow tentacles, according to one exemplary embodiment.

FIG. 4 is a top view of the tentacle-mounting side 114 of the base 110 of the hair drying and damage reduction system. Specifically, FIG. 4 shows the tentacle-mounting side 114 of the base 110 includes the stabilizers 160 and the perforated hollow tentacles 130. The stabilizers 160 prevent the tentacle-mounting side 114 of the base 110 of the hair drying and damage reduction system 100 from being pushed too close to the user's head when the user's hair is being dried. Additionally, the tips 134 and the hollow tube bodies 132 of each of the plurality of perforated hollow tentacles 130 may be seen. In other embodiments (not shown) of the hair drying and damage reduction system 100, a first set of the plurality of perforated hollow tentacles 130 are of a first length and the second set of the plurality of perforated hollow tentacles 130 are of a second longer length. This embodiment provides a different tactile sensation on the user's scalp due to the variety of tentacle lengths, and also provides variation in the disbursement pattern of the hot air from the perforated hollow tentacles 130.

Figure 5:
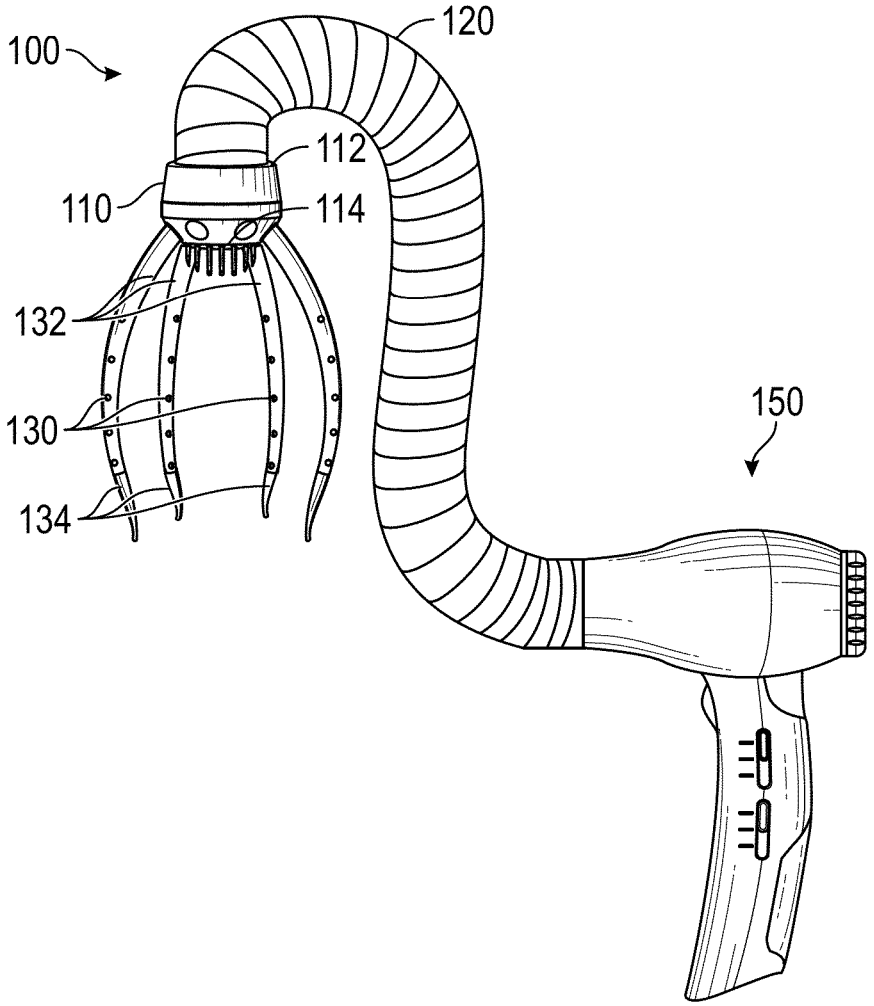
FIG. 5 is a side view drawing of the hair drying and damage reduction system attached to a hose, according to one exemplary embodiment.

Referring now to FIG. 5, a side view of the hair drying and damage reduction system 100 with an attached hose 120 is shown. In some embodiments, the hose 120 of the hair drying and damage reduction system 100 is limp and easily flexible, like a garden hose for water. In other embodiments, the hose 120 of the hair drying and damage reduction system 100 may be referred to as an octopus arm attachment 120 that is still flexible but more rigid, so that it will stay in a position into which it is bent, rather than collapsing back into limp position when not being actively bent into position. The hose 120 (or octopus arm attachment 120) are securable to the gripper opening side 112 of the base 110 hair drying and damage reduction system 100.

Accordingly, in an embodiment of the hair drying and damage reduction system 100 that incorporates an easily flexible hose 120, the user sets down an attached hair dryer 150 and simply holds the base 110 of the system 100 to dry the user's hair. In this embodiment, the user may easily move the base 110 of the system 100 around the user's head to dry the user's hair. In contrast, in an embodiment of the hair drying and damage reduction system 100 that incorporates a more rigid hose 120 (e.g., an octopus arm attachment 120), the octopus arm attachment 120 may be bent into a position for stationary hair drying, and the base 110 of the system 100 may be held by the user or secured into place (e.g., at a hair drying station). In still another of the hair drying and damage reduction system 100 that does not incorporate a hose 120 or octopus arm attachment 120, the base 110 of the system 100 is attached directly to a hair dryer 150, which may be held by the user or secured into place (e.g., at a hair drying station).

Figure 6:
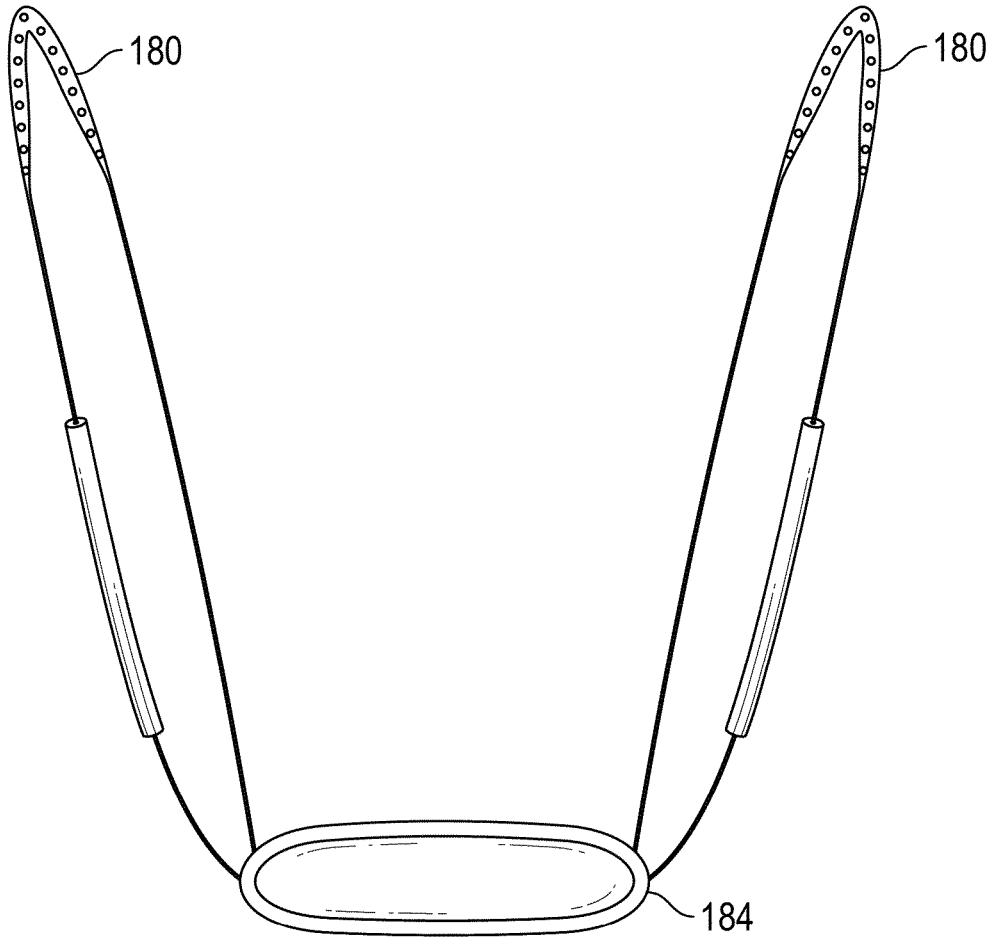
FIG. 6 is a top view of a hands-free attachment to the hair drying and damage reduction system with two adjustable length ear hooks that mount over the ears of a user, and a non-slip stretchable band that attaches around the base of the hair drying apparatus, according to one exemplary embodiment.

Referring now to FIG. 6, a hands-free attachment to the hair drying and damage reduction system 100 is shown. This embodiment of the hands-free attachment includes two ear loops 180 that mount over the ears of a user. In some embodiments, the two ear loops 180 include length adjustment bands 182 that may be used to adjust the length of the two ear loops 180 so that the hands-free attachment may be customized in size to correspond to a user's proportions. In another aspect of the hands-free attachment to the hair drying and damage reduction system 100, a non-slip stretchable band 184 is incorporated that attaches around the base 110 of the hair drying and damage reduction system 100. When the non-slip stretchable band 184 attaches the hands-free attachment to the base 110 of the hair drying and damage reduction system 100, then the two ear loops 180 may be used to hold the hair drying and damage reduction system 100 in position to dry a user's hair, without the user having to continuously hold the system 100.

Figure 7:
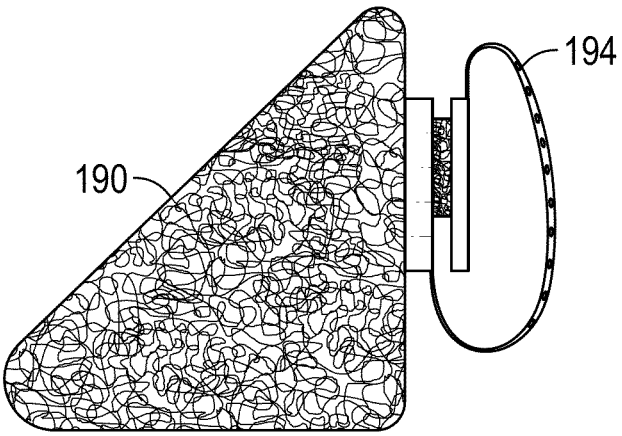
FIG. 7 is a side view of a hands-free wedge that is used to hold the hands-free version of the hair drying and damage reduction system in place and a Velcro strap that is used to attach to the hands-free version of the hair drying and damage reduction system, according to one exemplary embodiment.

FIG. 7 shows a hands-free wedge 190 that is incorporated in another aspect of a hands-free version of the hair drying and damage reduction system 100. In this version of the hands-free hair drying and damage reduction system 100, the system is held in place by positioning the hands-free wedge 190 on the user's neck or back. In this manner, the hands-free wedge 190 holds the base 110 and the perforated hollow tentacles 130 in the hair drying and damage reduction system 100 in the desired position for hair drying. In some embodiments, the hand-free wedge 190 is attachable to the base 110 of the hair drying and damage reduction system 100 using a hook and latch (e.g., Velcro™) strap 194.

Figure 8:
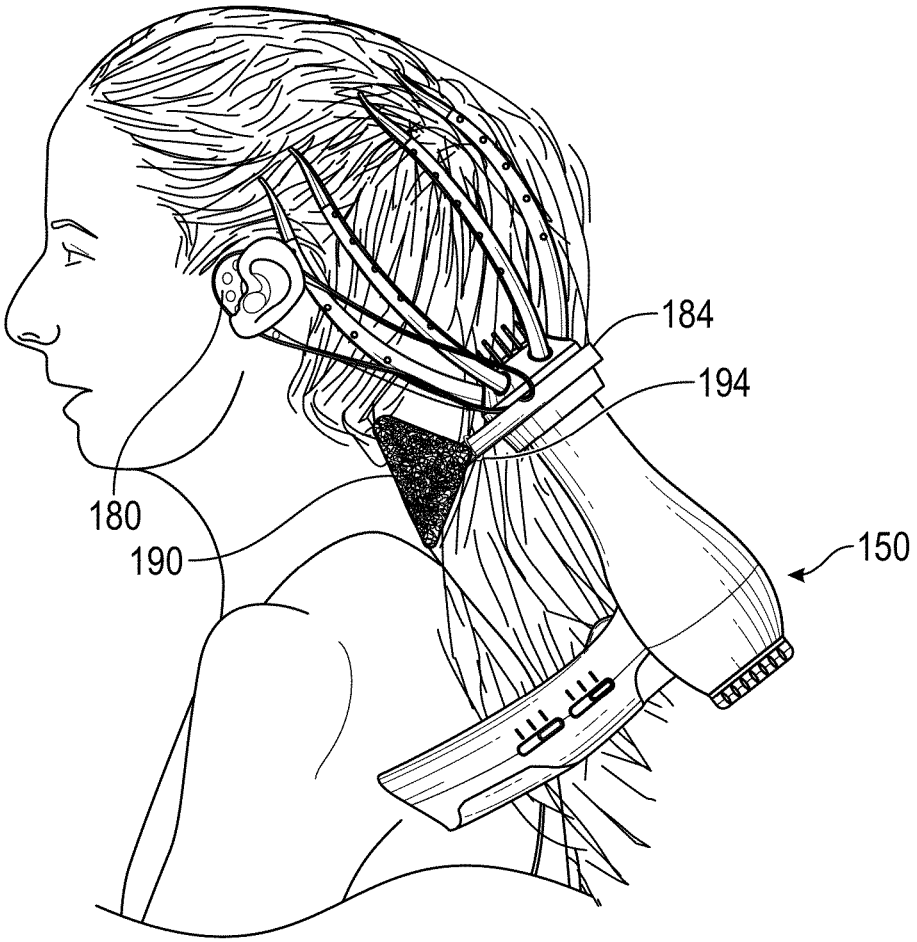
FIG. 8 is a perspective view of a hands-free version of the hair drying and damage reduction system with the wedge strapped to the base of the apparatus and the ear hooks and perforated hollow tentacles extended, according to one exemplary embodiment.

Referring now to FIG. 8, a hands-free version of the hair drying and damage reduction system 100 is shown that incorporates the ear loops 180 and non-slip stretchable band 184 of FIG. 6 as well as the hands-free wedge 190 of FIG. 7. In this embodiment, the hands-free wedge 190 is strapped to the base 110 of the hair drying and damage reduction system 100 using the hook and latch strap 194 and the non-slip stretch band 184, which is also connected to ear loops 180. In some such embodiments, the non-slip stretch band 184 secures to the base 110 of the system 100, and ear loops 180 secure the base 110 to ears of a user, via the non-slip stretch band 184, as shown in FIG. 9. The ear loops 180 and perforated hollow tentacles 130 extended to the left where they interact with the hair on a user's head to complete the hair drying process in a hands-free version of the hair drying and damage reduction system 100.

In another embodiment of the hair drying and damage reduction system 100, the system incorporates red light and/or infrared light emitters into the tentacle-mounting side 114 of the base 110. Such red light and/or infrared light emitters may include Light Emitting Diodes (LEDs). The design of the hair drying and damage reduction system 100 lends itself to the option of red and infrared type light therapy due to the proximity of the tentacles 130 of the system to the skin of the scalp and face. Light therapy performs well at the distance the hair drying and damage reduction system 100 is typically held from the scalp of a user during a hair drying session. In this manner, a user can obtain red light and/or infrared light therapy for their scalp (and potentially the user's face) while they are drying their hair.

In some embodiments, the wavelength for red light therapy of the of the hair drying and damage reduction system 100 is between 630 and 700 nanometers (nm). Within this range, some specific wavelengths that have shown better results for particular applications, namely the 630 nm wavelength for skin conditions such as acne and wrinkles, and the 660 nm wavelength for penetrating deeper into tissues for pain relief and muscle recovery. Additionally, the 850 nm wavelength for near-infrared can provide even deeper penetration for treating conditions such as joint pain and arthritis.

Light intensity decreases with distance so the farther the user is from the light source, the less intense the light is that reaches the user's scalp and face. Additionally, different tissues require different light intensities. For example, skin responds well to lower irradiance, while deeper tissues need higher intensity for effective penetration. In one embodiment, a high-power LED device (60-200 mW/cm$^2$) may require 5-10 minutes two to four times a week, which might relate well to a standard hair drying sessions by a user, depending on the length and thicken of the user's hair.

In still another embodiment of the hair drying and damage reduction system 100, the system incorporates a battery or is otherwise self-powered. By incorporating a battery or other self-powering system, the hair drying and damage reduction system 100 is free from being tethered to a traditional hair dryer. In another aspect of such an embodiment, the hair drying and damage reduction system 100 may include a blower fan as well as a battery, such that the hair drying and damage reduction system 100 is a complete stand-alone hair drying system. Moreover, in yet another embodiment of the hair drying and damage reduction system 100, the perforated hollow tentacles 130 incorporate heating elements, in addition to just being transport vessels for the hot air from the hair dryer 150. The heat from these heating elements in the tentacles 130 can be synergistically used to provide conductive hair drying in addition to the convective hair drying provided by the hot air from the hair dryer 150 via the tentacles 130.

In yet another embodiment of the hair drying and damage reduction system 100, the system incorporates electrodes in the tentacles 130 (preferably in the tips 134 of the tentacles 130) to provide electric stimulation therapy. This type of electric stimulation therapy uses low-voltage electrical currents to stimulate nerves and muscles to produce benefits such as pain relief, increased blood flow, and improved hair growth. For example, some embodiments of the hair drying and damage reduction system 100 may incorporate low voltage stimulation, such as Transcutaneous Electrical Nerve Stimulation (TENS) devices with low-voltage currents (20 and 35 volts) to stimulate nerves, increase blood flow, and alleviate pain. Other potential embodiments may incorporate low amplitude and high frequency (90-130 Hz) to stimulate large diameter nerve fibers for pain relief.

Additionally, or in the alternative, the hair drying and damage reduction system 100 may also activate movement of the tentacles 130 with respect to the tentacle-mounting side 114 of the base 110 to provide a massaging motion on the scalp of the user. In this manner, the hair drying and damage reduction system 100 may provide electric stimulation therapy and/or massage concurrently with the hair drying functions of the system in some embodiment, while in other embodiments, hair drying and damage reduction system 100 may provide electric stimulation therapy and/or massage consecutively with the hair drying functions of the system.

Certain words and phrases used in the specification are set forth as follows. As used throughout this document, including the claims, the singular form "a", "an", and "the" include plural references unless indicated otherwise. Any of the features and elements described herein may be singular, e.g., a sensor may refer to one sensor and a memory may refer to one memory. The terms "include" and "comprise," as well as derivatives thereof, mean inclusion without limitation. The term "or," is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this patent document.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the present disclosure.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described exemplary embodiments, but should be defined only in accordance with the following claims and their equivalents.

The invention claimed is:

1. A system for hair drying and damage reduction, the system comprising:

a base having a gripper opening side and a tentacle-mounting side, the gripper opening side including a single central opening and the tentacle-mounting side including a plurality of apertures through which heated air passes;

a hose that attaches to the gripper opening side of the base at a first end and attaches to a hair dryer at a second end; and a plurality of perforated hollow tentacles, each tentacle having a hollow tube root and a closed tip, the hollow tube root of each tentacle being configured to mount in one of the plurality of apertures in the tentacle-mounting side of the base.

2. The system of claim 1, wherein a first set of the plurality of perforated hollow tentacles are of a first length and a second set of the plurality of perforated hollow tentacles are of a second longer length.

3. The system of claim 1, wherein some of the plurality of apertures in the tentacle-mounting side of the base are mounted with stabilizing members that are shorter than the plurality of perforated hollow tentacles.

4. The system of claim 1, wherein the tentacles have an exterior surface, and wherein the exterior surface of the tentacles is perforated over 360 degrees of the exterior surface for even hair drying.

5. The system of claim 1, wherein the tips of the plurality of perforated hollow tentacles are tapered or capped.

6. The system of claim 1, further comprising an octopus arm attachment that is securable to the gripper opening side of the base.

7. The system of claim 1, further comprising a hand-free wedge for positioning the base and the plurality of perforated hollow tentacles, wherein the hand-free wedge is attachable to the base using a hook and latch strap.

8. The system of claim 1, further comprising a hand-free neck loop, wherein the hand-free neck loop includes a single loop that secures the base to a neck of a user.

9. The system of claim 1, further comprising a hand-free base positioning system that includes a non-slip stretch band that is connected to ear loops, wherein the non-slip stretch band secures to the base and ear loops secure the base to ears of a user.

10. A method for hair drying and damage reduction, the method comprising:

securing a plurality of perforated hollow tentacles to a plurality of apertures in a tentacle-mounting side of a base of a hair drying and damage reduction system, each tentacle having a hollow tube root and a closed tip, the hollow tube root of each tentacle being configured to mount in one of the plurality of apertures in the tentacle-mounting side of the base;

securing a hose of the hair drying and damage reduction system to a gripper opening side of the base of the hair drying and damage reduction system at a first end of the hose;

securing the hose of the hair drying and damage reduction system to a hair dryer at a second end of the hose;

positioning the plurality of perforated hollow tentacles into hair on a scalp of a user to dry the hair of the user, wherein the plurality of perforated hollow tentacles are positioned to dry hair near the scalp prior to drying hair farther away from the scalp; and enabling activation of a hair dryer that directs air through the base and the plurality of perforated hollow tentacles of the hair drying and damage reduction system into the hair on the scalp of the user to evenly dry the hair of the user without damaging the hair.

11. The method of claim 10, wherein a first set of the plurality of perforated hollow tentacles are of a first length and a second set of the plurality of perforated hollow tentacles are of a second longer length.

12. The method of claim 10, wherein some of the plurality of apertures in the tentacle-mounting side of the base are mounted with stabilizing members that are shorter than the plurality of perforated hollow tentacles.

13. The method of claim 10, wherein the tentacles have an exterior surface, and wherein the exterior surface of the tentacles is perforated over 360 degrees of the exterior surface for even hair drying.

14. The method of claim 10, wherein the tips of the plurality of perforated hollow tentacles are tapered or capped.

15. The method of claim 10, wherein an octopus arm attachment is securable to the gripper opening side of the base.

16. The method of claim 10, further comprising positioning a hand-free wedge for the base and the plurality of perforated hollow tentacles, wherein the hand-free wedge is attachable to the base using a hook and latch strap.

17. The method of claim 10, further comprising securing a hand-free neck loop to the base, wherein the hand-free neck loop includes a single loop that secures the base to a neck of a user.

18. The method of claim 10, further comprising securing a hand-free base positioning system to the base, wherein the hand-free base positioning system includes a non-slip stretch band that is connected to ear loops, and wherein the non-slip stretch band secures to the base and ear loops secure the base to ears of a user.

19. A system for hair drying and damage reduction, the system comprising:

a base having a gripper opening side and a tentacle-mounting side, the gripper opening side including a single central opening and the tentacle-mounting side including a plurality of apertures through which heated air passes;

a hair dryer that attaches to the gripper opening side of the base at a first end; and a plurality of perforated hollow tentacles, each tentacle having a hollow tube root and a closed tip, the hollow tube root of each tentacle being configured to mount in one of the plurality of apertures in the tentacle-mounting side of the base.

20. The system of claim 19, wherein the tentacles have an exterior surface, and wherein the exterior surface of the tentacles is perforated over 360 degrees of the exterior surface for even hair drying.

* * * * *